US006331808B2

(12) United States Patent
Mikami et al.

(10) Patent No.: US 6,331,808 B2
(45) Date of Patent: Dec. 18, 2001

(54) DIELECTRIC RESONATOR DEVICE

(75) Inventors: Shigeyuki Mikami, Nagaokakyo; Toshiro Hiratsuka, Kusatsu; Tomiya Sonoda, Muko, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/736,484

(22) Filed: Dec. 13, 2000

Related U.S. Application Data

(63) Continuation of application No. 09/283,803, filed on Apr. 1, 1999, now Pat. No. 6,177,854.

(30) Foreign Application Priority Data

Apr. 3, 1998 (JP) ..... 10-91986
Mar. 9, 1999 (JP) ..... 11-062217

(51) Int. Cl.[7] ..... H01P 5/12; H01P 1/20; H01P 7/10

(52) U.S. Cl. ..... 333/134; 333/202; 333/219.1

(58) Field of Search ..... 333/202, 204, 333/219.1, 135, 134

(56) References Cited

U.S. PATENT DOCUMENTS 5,764,116 * 6/1998 Ishikawa et al. ..... 333/202
6,016,090 * 1/2000 Lio et al. ..... 333/202

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

A dielectric resonator device having characteristics of a plane circuit type dielectric resonator device applicable to miniaturization is included. Non-loading Q0 of a resonator is increased so as to decrease insertion loss in the case of forming a band sass filter, or the like. Changes in filter characteristics with respect to changes in structural dimensions of the length of the resonator, the gap between the resonators, or the like, are reduced. There is an increase in the freedom in adjustment of resonant frequency to enhance production efficiency. In this arrangement, on each main surface of a dielectric plate is disposed an electrode having mutually opposing openings, which serve as a rectangular-slot mode dielectric resonator; in which the length of the resonator is longer than a half-wave length at the resonant frequency being used so as to resonate in a higher mode.

40 Claims, 13 Drawing Sheets

DIELECTRIC RESONATOR DEVICE

This is a continuation of application Ser. No. 09/283,803, filed Apr. 1, 1999, allowed, now U.S. Pat. No. 6,177,854.

BACKGROUND OF THE INVENTION

1. Field of the Invention

The present invention relates to a dielectric resonator device used in a microwave band and a millimeter-wave band.

2. Description of the Related Art conventionally, there has been a demand for miniaturizing dielectric resonator devices such as filters, oscillators, or the like, which incorporate dielectric resonators. In response to the demand, a plane circuit type dielectric resonator device has been developed. For example, there is a "para-millimeter wave band pass filter equipped with a plane circuit type dielectric resonator", 1996, Institute of Electronics, Information and Communication Engineers General Meeting C-121, and a "plane circuit type dielectric resonator device" in Japanese Patent Application No. 9-101458.

FIGS. 14 and 15 show an example of a dielectric resonator device employed in the above patent application. FIG. 14 is an exploded perspective view of the device. In this figure, electrodes having three mutually opposing pairs of rectangular openings are disposed on each of both main surfaces of a dielectric plate 1. On the upper surface of an I/O substrate 7 are disposed microstrip lines 9 and 10 which are used as probes, and on substantially the entire lower surface of the same is formed a ground electrode. A single dielectric resonator device is formed by sequentially stacking a spacer 11, the dielectric plate 1, and a cover 6 on the I/O substrate 7. FIGS. 15A, 15B, and 15C respectively show an electromagnetic field distribution view of three resonators formed in the dielectric plate 1. FIG. 15A is a plan view of the dielectric plate 1; FIG. 15B is a sectional view of three electrode openings 4*a*, 4*b*, and 4*c*; and FIG. 15C is a sectional view in the narrow side direction of the dielectric plate 1. The rectangular electrode openings 4*a*, 4*b*, and 4*c* having a length L and a width W, which are mutually opposed having the dielectric plate 1 therebetween are formed at given gaps g. This arrangement permits formation of a dielectric resonator with a rectangular slot mode on each of the electrode openings 4*a*, 4*b*, and 4*c*, leading to formation of a filter having three-step resonators in the overall structure.

The conventional type of dielectric resonator device shown in FIGS. 14 and 15 is extremely miniaturized overall, since it is a plane circuit type device in which a resonator is formed in a dielectric plate. However, in the conventional type of device incorporating a dielectric resonator with a rectangular slot mode, for example, non-loading loading Q (hereinafter referred to as Q0) is not higher than that in a dielectric resonator with the TE01δ mode, since conductor loss of electrodes formed on both main surfaces of the dielectric plate is large. This causes a problem such as increase in insertion loss when a band pass filter is formed. In order to increase Q0 of the resonator it is effective to make the width of the resonator (the width W of the electrode opening) longer than the length of the same (the length L of the electrode opening). In this case, however, the resonant frequency of a mode (where the directional relationship between the width and length of the electrode opening is reversed), in which the electric field direction is orthogonal to a basic resonant mode, is close to a frequency of a basic mode, resulting in degradation of spurious characteristics.

In addition, in the conventional type of rectangular slot mode resonator, there are great changes in filter characteristics with respect to changes in structural dimensions of the length L and gap g of the resonator. This leads to decrease in production efficiency.

Furthermore, in this conventional type of device, adjustment of the resonant frequency performed by giving perturbation to the magnetic field and the electric field also decreases production efficiency, since control in adjustment is difficult due to great perturbation quantity.

SUMMARY OF THE INVENTION

Accordingly, it is an object of the present invention to provide a dielectric resonator device which has characteristics of a plane circuit type dielectric resonator device applicable to miniaturization, and which further can overcome the above-mentioned problems.

To this end, the present invention provides a dielectric resonator device which includes a dielectric plate; an electrode disposed on each main surface of the dielectric plate; at least one pair of substantially-polygonal mutually opposing openings formed in the electrodes; a signal input unit for inputting signals from the outside by coupling with a resonator unit formed of the electrode openings and a signal output unit for outputting signals to the outside by coupling with the resonator unit; in which the length L in the longer side direction of at least one of the openings is longer than a half-wave length of a basic resonant mode determined by a half-wave length in resonant frequency used so as to resonate in a higher mode of the basic resonant mode.

This structure allows the resonator unit to resonate in a higher mode of the basic resonant mode, thereby, resulting in formation of an electrical barrier with no loss between gnarls of electromagnetic distributions. With the electrical barrier with no conductive loss, The entire conductive loss is decreased and Q0 of the resonator is increased, so that insertion loss is reduced in forming a filter. Since the number of the electrical barriers formed, when a resonant degree is represented by n, is represented by n−1, the larger the resonant degree, the less the overall conductive loss. However, since this increases the length L of the resonator, the resonant degree n is eventually determined while considering miniaturization of the device.

Furthermore, in the rectangular-slot mode resonator, as the resonant degree becomes larger, lock-in effects of electromagnetic field energy in the inside of the resonator become higher, so that the filter characteristic changes with respect to changes in the resonator length L and the gaps g between the resonators become smaller. As a result, the present invention can enhance production efficiency.

In addition, although the strength distribution of electromagnetic field forms only one wave in the case of a basic mode resonator, distributions of the number corresponding to the resonant degree are presented in the case of a higher mode resonator, so that perturbation effects on electric fields or magnetic fields can be differentiated according to the distribution of electromagnetic field energy. For example, the insertion amount of a metallic screw in an area where electromagnetic field strength is large permits coarse adjustment of resonant frequency, whereas the insertion amount of a metallic screw in an area where electromagnetic field strength is small permits fine adjustment of resonant frequency.

DESCRIPTION OF THE PREFERRED EMBODIMENTS

Referring now to FIGS. 1 to 6, a description will be given of a structure of a dielectric resonator device according to an embodiment of the present invention.

Figure 1:
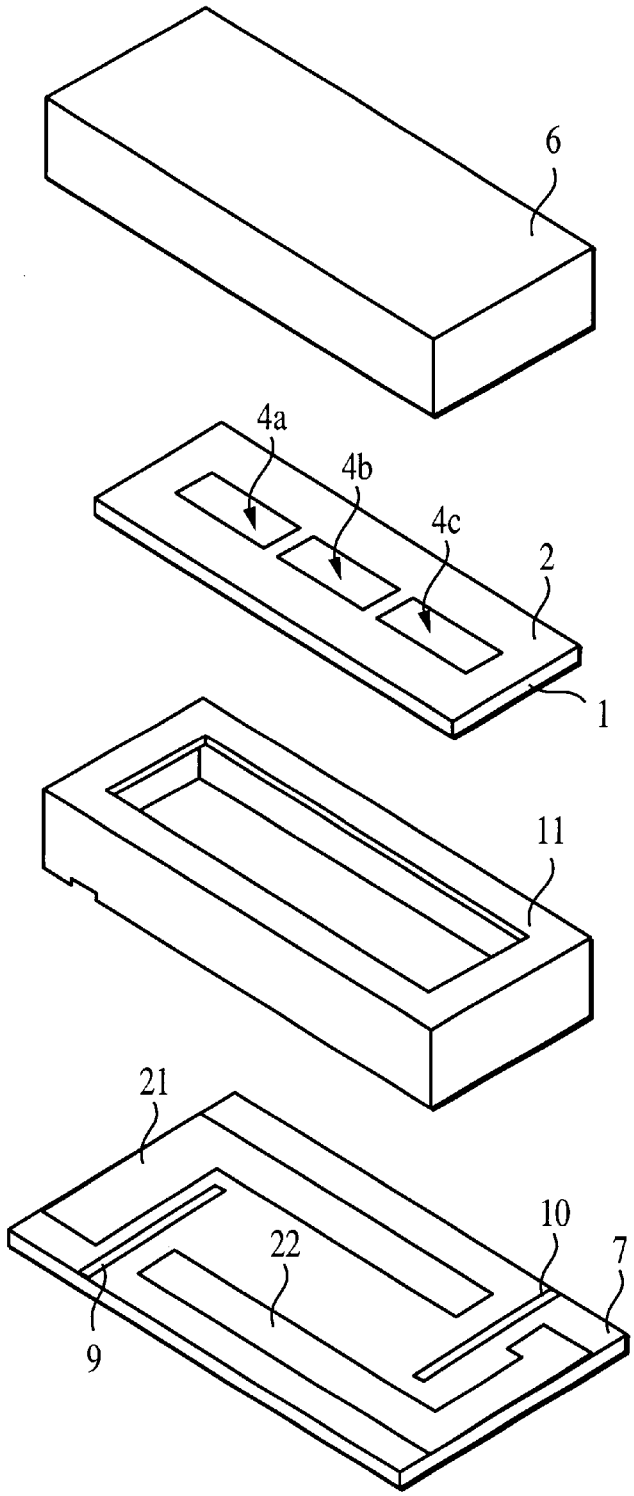
FIG. 1 is an exploded perspective view of a dielectric resonator device according to an embodiment of the present invention.
Figure 2A:
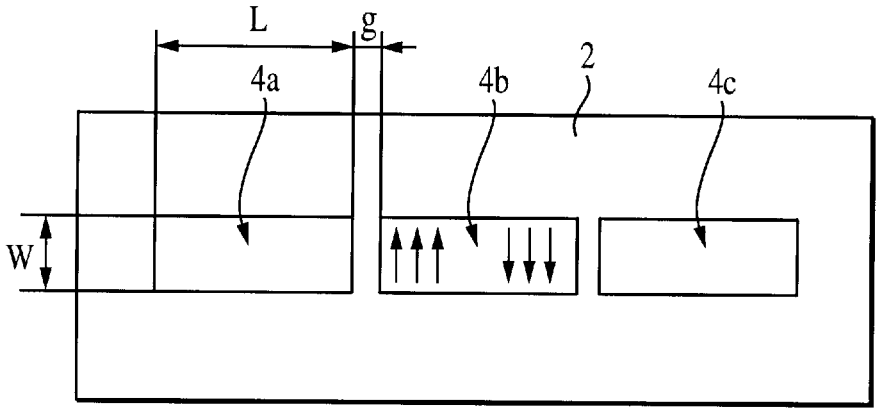
FIGS. 2A, 2B, and 2C respectively show an electromagnetic field distribution view of a resonator employed in the dielectric resonator device.
Figure 2C:
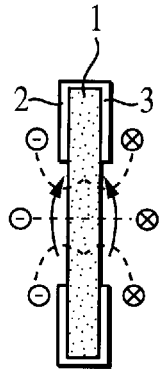
Figure 2B:
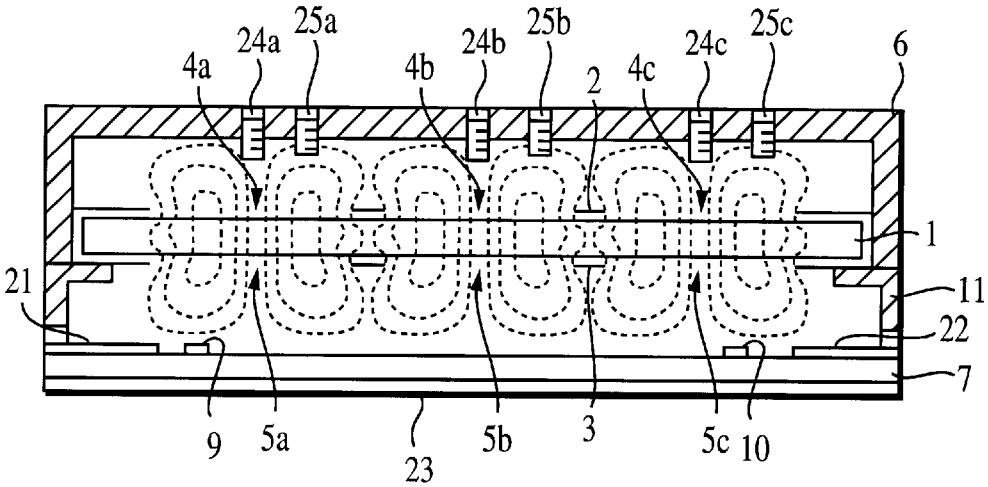

FIG. 1 is an exploded perspective view of the dielectric resonator device. In this figure, reference numeral 1 denotes a dielectric plate; and on each main surface of the dielectric plate is formed an electrode having three mutually opposing pairs of rectangular openings. Reference numeral 7 denotes an I/O substrate, on the upper surface of which microstrip lines 9 and 10 used as probes are formed; and on substantially the entire lower surface of the substrate is formed a ground electrode. Reference numeral 11 denotes a spacer which is in a form of metallic frame. The spacer 11 is stacked on the I/O substrate 7 and then the dielectric plate 1 is placed thereon so as to make a specified distance between the :1O substrate 7 and the dielectric plate 1. A cut-away part is formed at each part opposing the microstrip lines 9 and 10 of the spacer 11, so that microstrip lines 9 and 10 are not shunted. Reference numeral 6 denotes a metallic cover, which performs electromagnetic shielding in the circumference of the dielectric plate 1 when it encloses the spacer 11 FIGS. 2A, 2B and 2*c* respectively show a view of electromagnetic distribution of three resonator units formed on the dielectric plate 1. FIG. 2A is a plan view of the dielectric plate 1; FIG. 2B is a sectional view crossing each of the opposing three electrode openings; and FIG. 2C is a sectional view in the shorter side direction of the dielectric plate 1. Rectangular electrode openings 4*a*, 5*a*, 4*b*, 5*b*, 4*c*, and 5*c* with the length L and the width W, which are opposing through the dielectric plate 1 disposed therebetween are formed at a specified gap g. This structure allows each of the electrode openings 4*a*, 5*a*, 4*b*, 5*b*, 4*c* , and 5*c* to operate as a rectangular-slot mode dielectric resonator so as to produce magnetic coupling between the adjacent resonators. The microstrip line 9 is magnetically coupled with the resonator formed of the electrode openings 4*a* and 5*a*; and the microstrip line 10 is magnetically coupled with the resonator formed of the electrode openings 4*c* and 5*c*. This arrangement permits formation of a filter comprising three-step resonators overall.

In the rectangular-slot mode dielectric resonator, the resonant frequency is determined by the resonator length L, the resonator width W, and the thickness and dielectric constant of the dielectric plate 1. In this figure, the resonator length L is equivalent to substantially twice the resonator length of a basic resonant mode resonator, namely, equivalent to a wavelength in the resonant frequency used. This permits formation of a second-higher mode (hereinafter referred to as "double mode") resonator, as shown in FIGS. 2A and 2B, thereby leading to occurrence of an electrical barrier at a center of the resonator length L. A solid line with an arrow in FIG. 2A indicates an electrodynamic line; and a broken line in FIG. 2B indicates a magnetic line. The electromagentic field is distributed as indicated here; in which although current flows to the shorter side part of the periphery of the electrode opening and conductor loss is generated at the part, there is no conductor present at the central electrical barrier, so that no conductor loss is generated at this part. Thus, the entire conductor loss is decreased so as to produce a dielectric resonator with high Q0.

Moreover, since lock-in effects of electromagnetic field energy in the higher-mode resonator are greater than in a basic mode resonator, changes in filter characteristics with respect to changes in the resonator length L and in the gap g between the resonators in the higher-mode resonator are smaller than those in the basic mode resonator. Thus, stable filter characteristics can be obtained regardless of the dimensional accuracy of electrodes 2 and 3, to some extent.

In FIG. 2B, there are shown 24*a*, 25*a*, 24*b*, 25*b*, 24*c*, and 25*c* as respective screws for adjusting resonant frequency of the resonators; in which 24*a*, 24*b*, and 24*c* are respectively positioned at the electrical barrier generated at the center of the resonator length L. The screws 25*a*, 25*b*, and 25*c* are respectively positioned near the top end of the resonator length L. Since the screws 24*a*, 24*b*, and 24*c* for adjusting resonant frequency of the resonators are positioned in an area where magnetic field energy density is high, the screw insertion amount greatly perturbs the magnetic field of each resonator so as to allow coarse adjustment of resonant frequency. In addition, the screws 25*a*, 25*b*, and 25*c* are respectively positioned in an area where magnetic field energy density is low, the screw insertion amount slightly perturbs the magnetic field of each resonator so as to perform fine adjustment of resonant frequency. In this way, a combination of coarse adjustment and fine adjustment permits a coarse and fine adjustment of resonant frequency of the resonator, resulting in enhancement of production efficiency.

Figure 3:
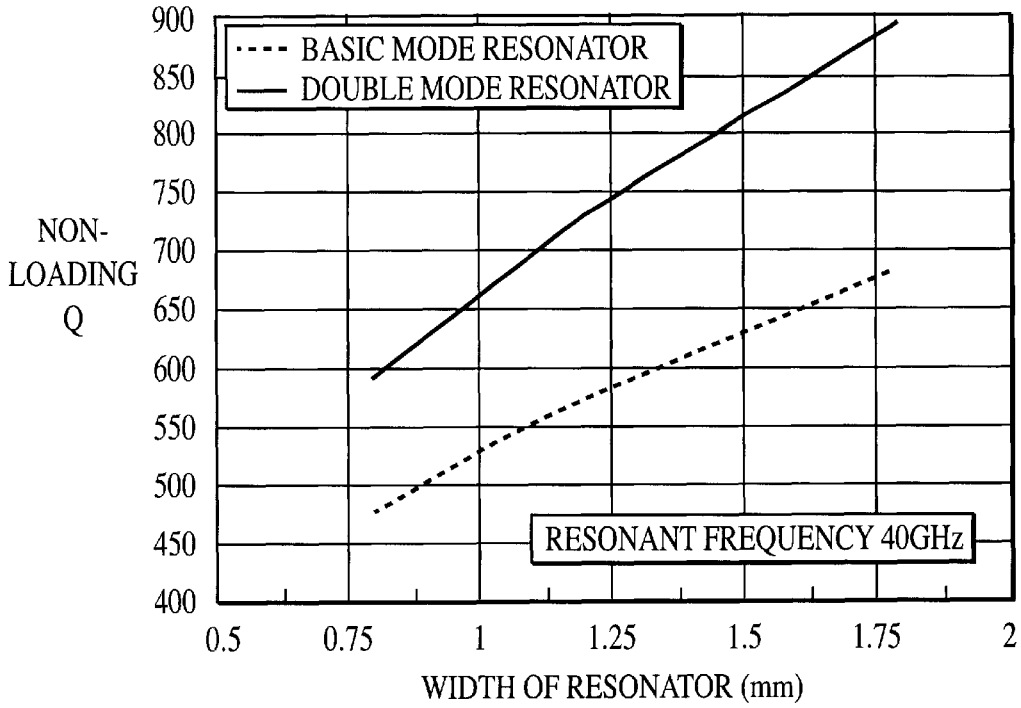
FIG. 3 is a graph showing the relationship between the width of a resonator and non-loading Q regarding a basic mode resonator and a double mode resonator.

FIG. 3 shows non-loading ratio Q with respect to some resonator widths W regarding a basic resonant mode (hereinafter simply referred to as a "basic mode") resonator and a double mode resonator. As seen here, high non-loading ratio Q can be obtained regardless of the resonator widths W. When this resonator is used in a band pass filter with center frequency of 40 GHz and fractional bandwidth of 2%, insertion loss in the case of the double mode is about 20% improved over that of the basic mode.

Figure 4:
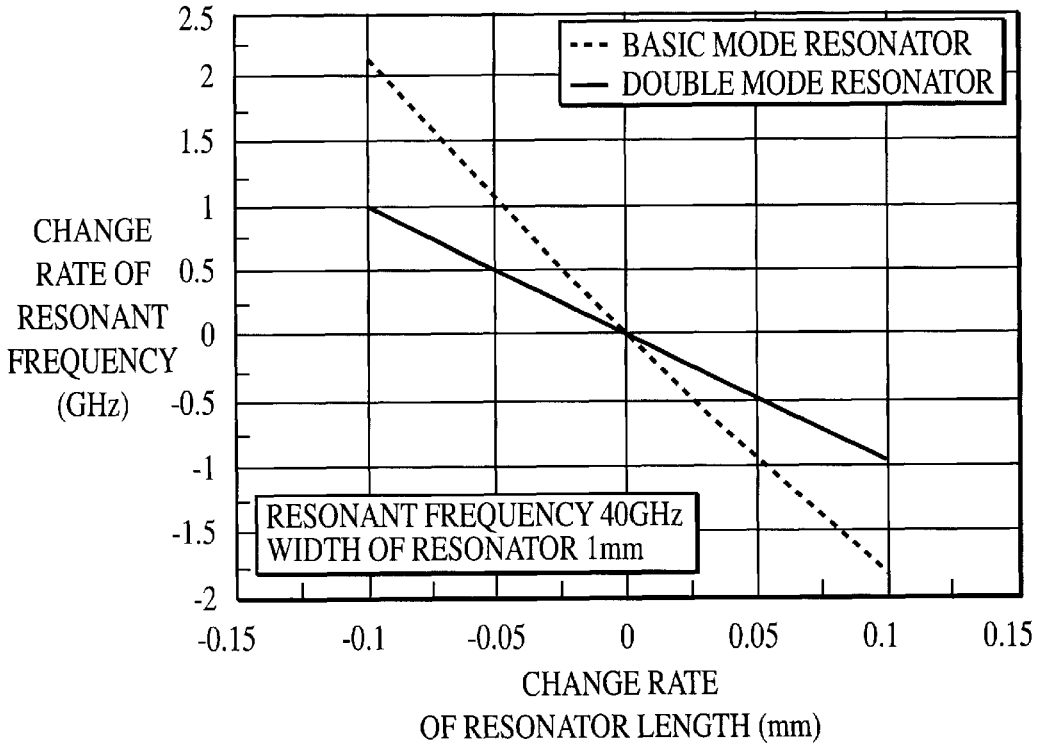
FIG. 4 is a graph showing the relationship between change rates in the length of the resonator and in the resonant frequency regarding the basic mode resonator and the double mode resonator.
Figure 5:
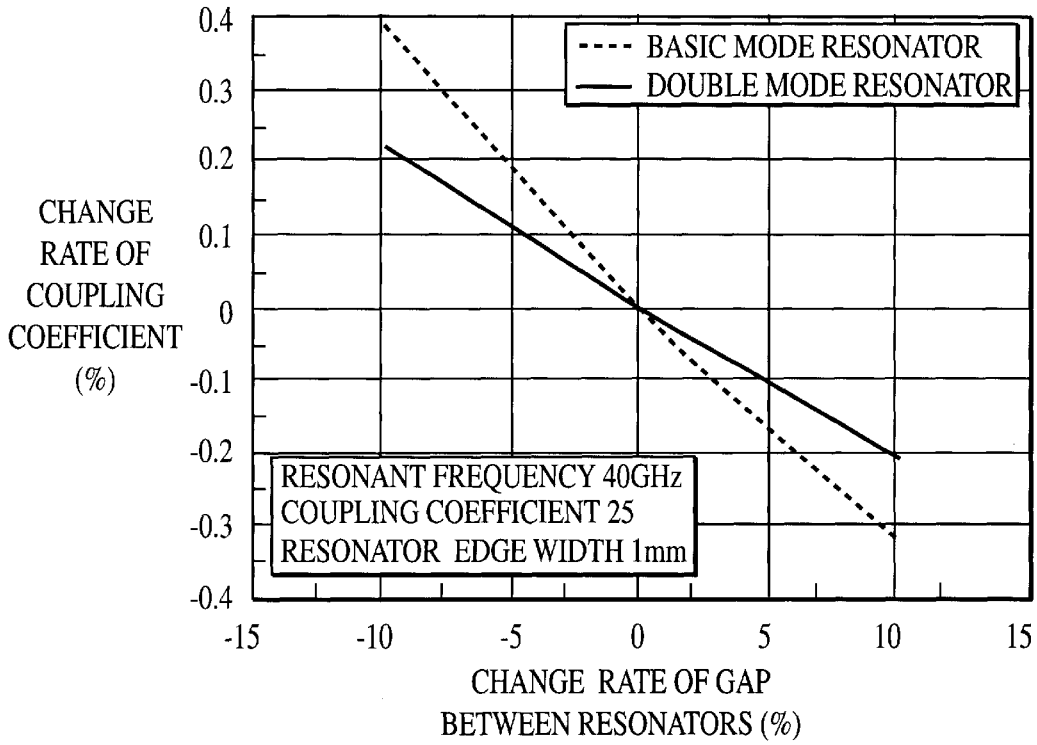
FIG. 5 is a graph showing the relationship between change rates in the gap between the resonators and in the coupling coefficients regarding the basic mode resonator and the double mode resonator.

FIG. 4 shows change rates of resonant frequency when the resonator length L is different regarding the basic mode resonator and the double mode resonator. FIG. 5 shows change rates of coupling coefficients with respect to change rates of the gap g between the resonators. These results clearly show that, comparing the double mode resonator with the basic mode resonator, changes in resonant frequency with respect to changes in the resonant length L, and changes in coupling coefficients with respect to changes of the gap g between the resonators are smaller in the double mode resonator than in the basic mode resonator.

Figure 6:
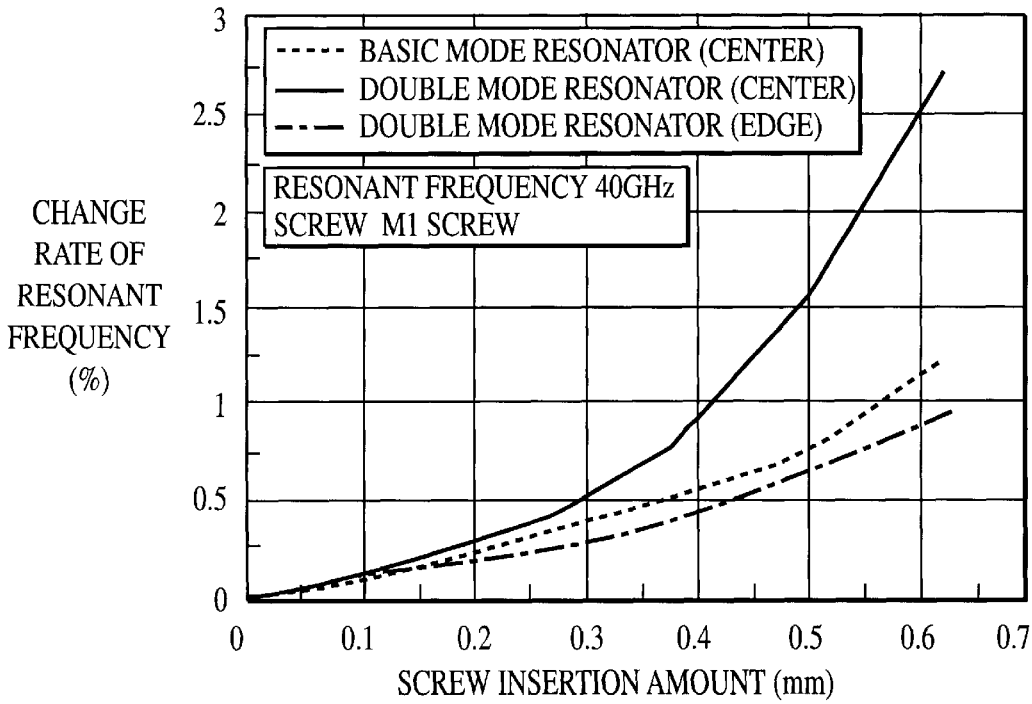
FIG. 6 is a graph showing the relationship between insertion amounts of a screw for adjusting resonant frequency and change rates in the resonant frequency regarding the basic mode resonator and the double mode resonator.

FIG. 6 shows the relationship between change rates of resonant frequency and insertion amounts of screws for adjusting resonant frequency regarding the basic mode resonator and the double mode resonator. In the basic mode resonator, there is shown a case in which the screw for adjusting resonant frequency is inserted at the center of the resonator. As shown in this figure, in the double mode resonator, change rates in resonant frequency with respect to insertion amounts of the screw for adjusting resonant frequency, which is inserted into the center, are large; in contrast, change rates in resonant frequency with respect to insertion amounts of the screw for adjusting resonant frequency, which is inserted near the edge of the resonator are small.

Figure 7A:
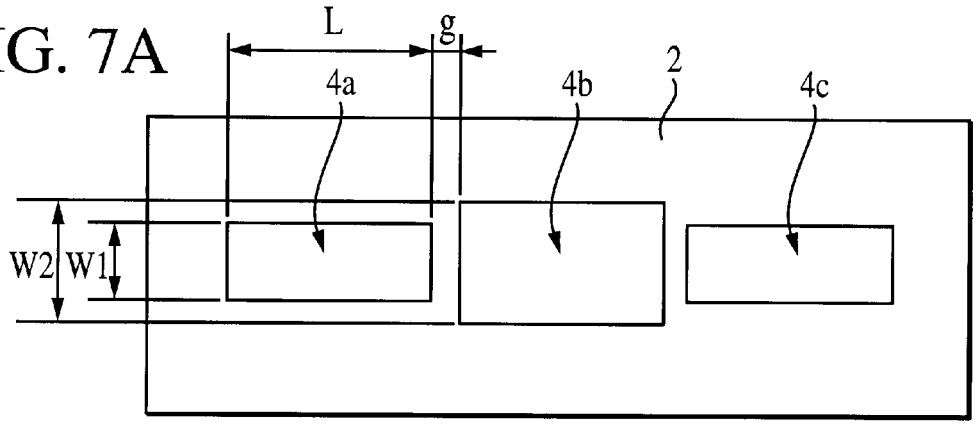
FIGS. 7A, 7B, and 7C respectively show a plan view illustrating a structure of a dielectric plate of a dielectric resonator device according to another embodiment of the present invention.
Figure 7B:
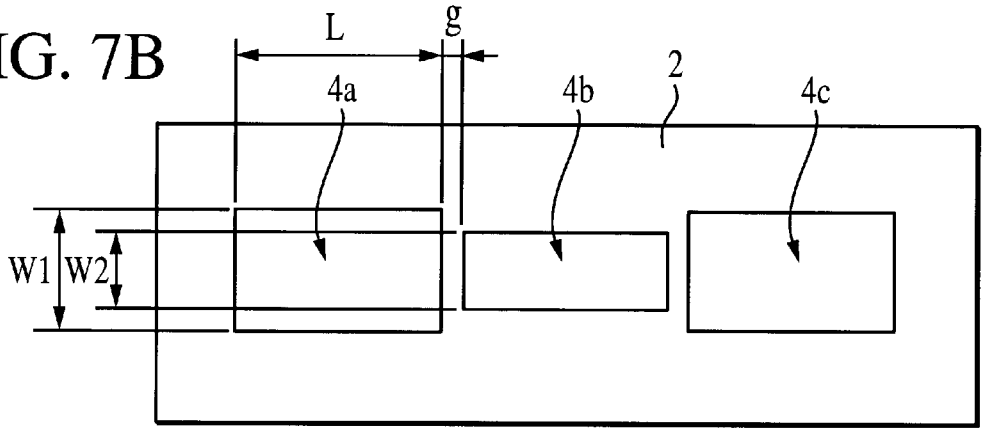
Figure 7C:
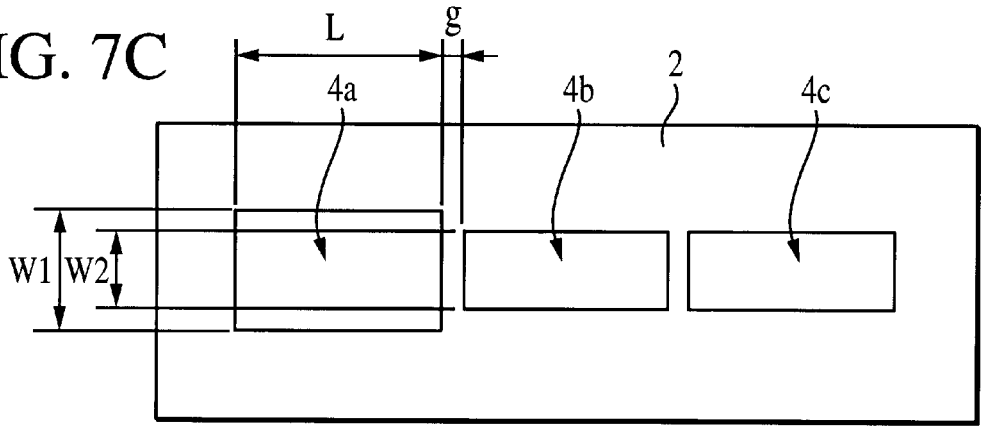

FIGS. 7A, 7B, and 7C respectively show an example in which the form of an electrode opening disposed on the dielectric plate is different. They respectively show a plan view of the dielectric plate, in which resonators with different widths are positioned together. The resonator length L and the resonator widths W1 and W2 may be determined according to characteristics necessary for each resonator. More specifically, as shown in FIG. 7B, expanding the resonator width W1 of a first-step resonator and a third-step resonator coupled with probes permits the resonators to be coupled with the probes more securely, despite the fact that they are double-mode resonators with higher energy-lock-in effects.

Figure 8A:
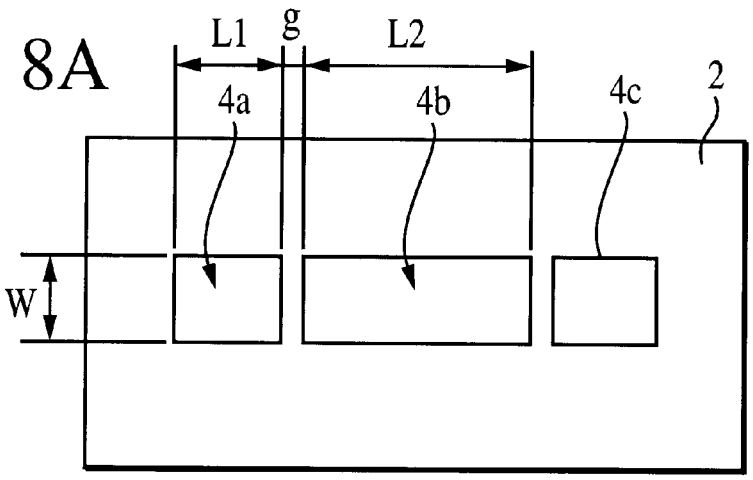
FIGS. 8A, 8B, and 8C respectively show a plan view illustrating a structure of a dielectric plate of a dielectric resonator device according to another embodiment of the present invention.
Figure 8B:
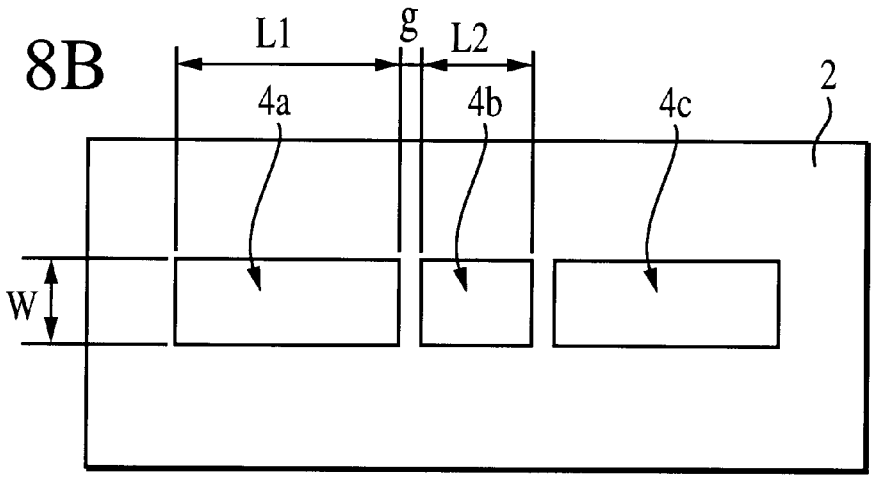
Figure 8C:
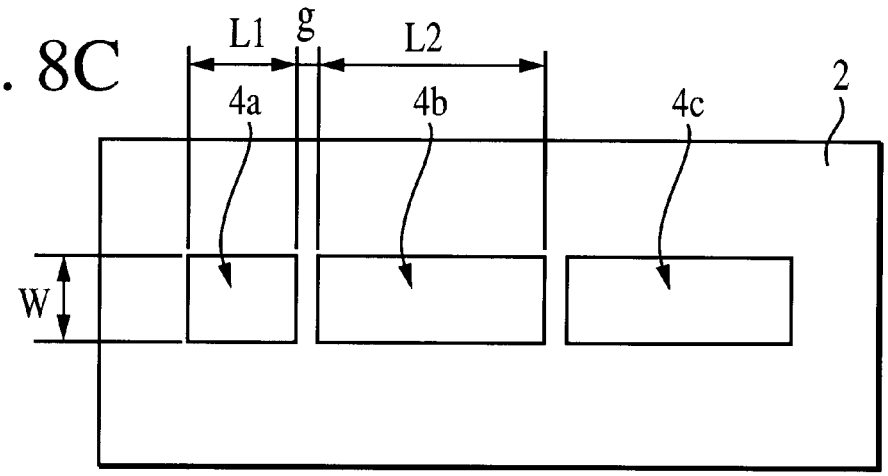

FIGS. 8A, 3B, and 8*c* respectively show an example in which a plurality of resonators having different lengths are disposed together. The lengths L1 and L2 of each-step resonator may be determined according to characteristics required for each resonator. More specifically, as shown in FIGS. 8A and 8C, when a first-step resonator or a third-step resonator coupled with the probes is a resonator in which the resonator length L1 is set to substantially half-wave length in resonant frequency used, namely, a basic mode resonator, this facilitates coupling between the resonator and the probe, thereby, facilitating its coupling with an external circuit. In other words, a basic resonant mode offers lower lock-in effect of electromagnetic fields than a higher resonant mode does, so that a specified coupling degree can be obtained even though the dielectric plate is positioned away from the probe at some distance.

Figure 9A:
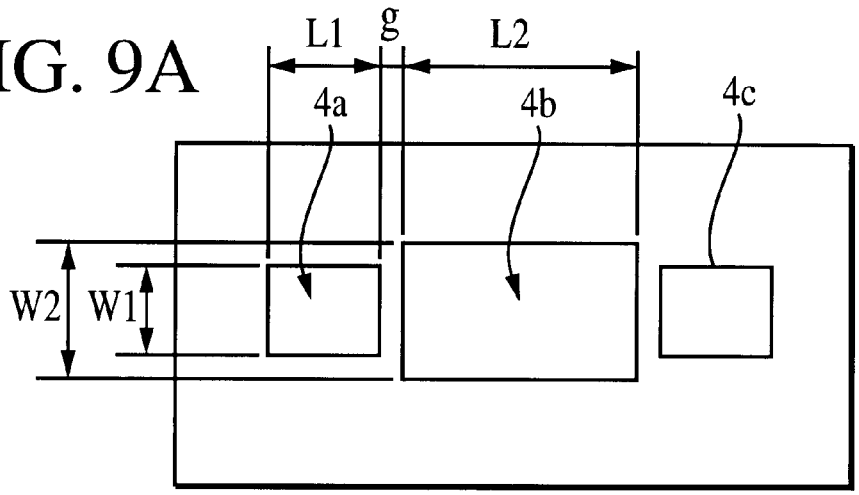
FIGS. 9A, 9B, and 9C respectively show a plan view illustrating a structure of a dielectric plate of a dielectric resonator device according to another embodiment of the present invention.
Figure 9B:
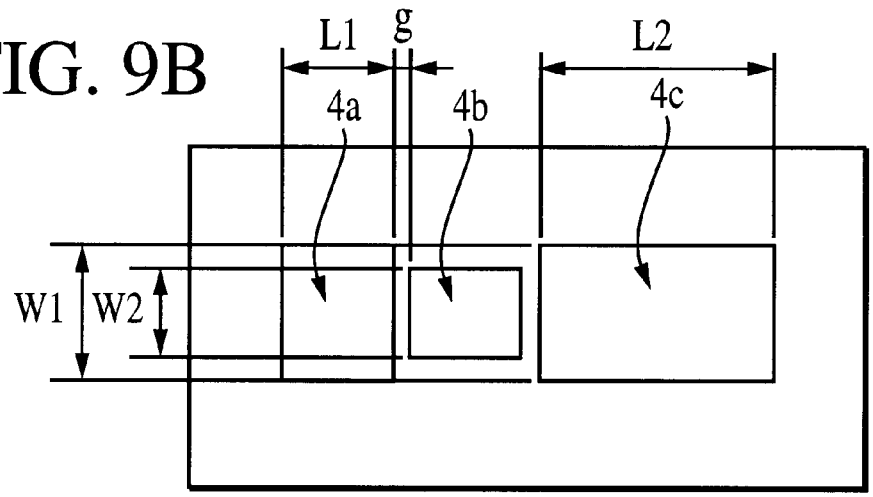
Figure 9C:
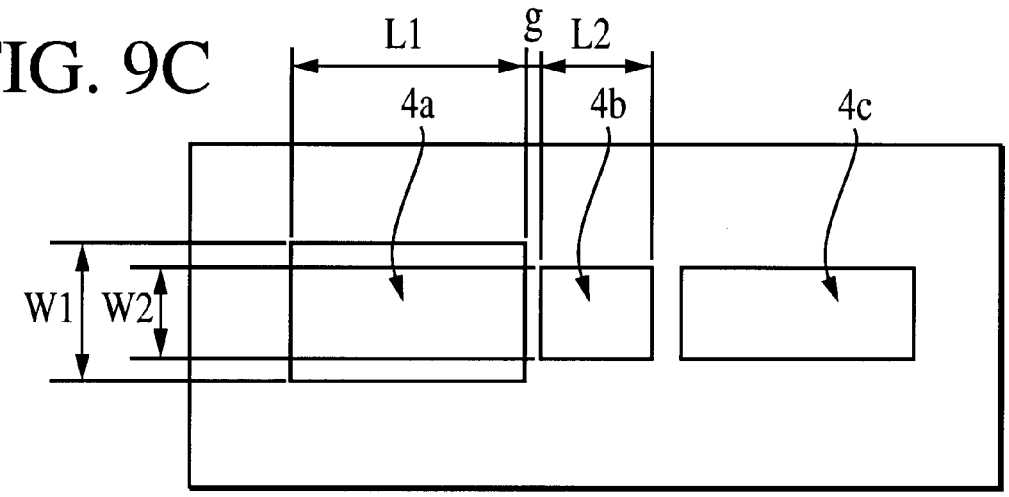

FIGS. 9A, 9B, and 9C respectively show an example in which resonators with different widths and lengths are disposed together. Similarly, the lengths L1 and L2 and the widths W1 and W2 may be determined according to characteristics required for each resonator, degrees of coupling between the resonator and the probe, etc.

Although the embodiments described above adopt a rectangular form for the electrode opening, other forms for the electrode opening are shown in FIGS. 10 and 11.

Figure 10A:
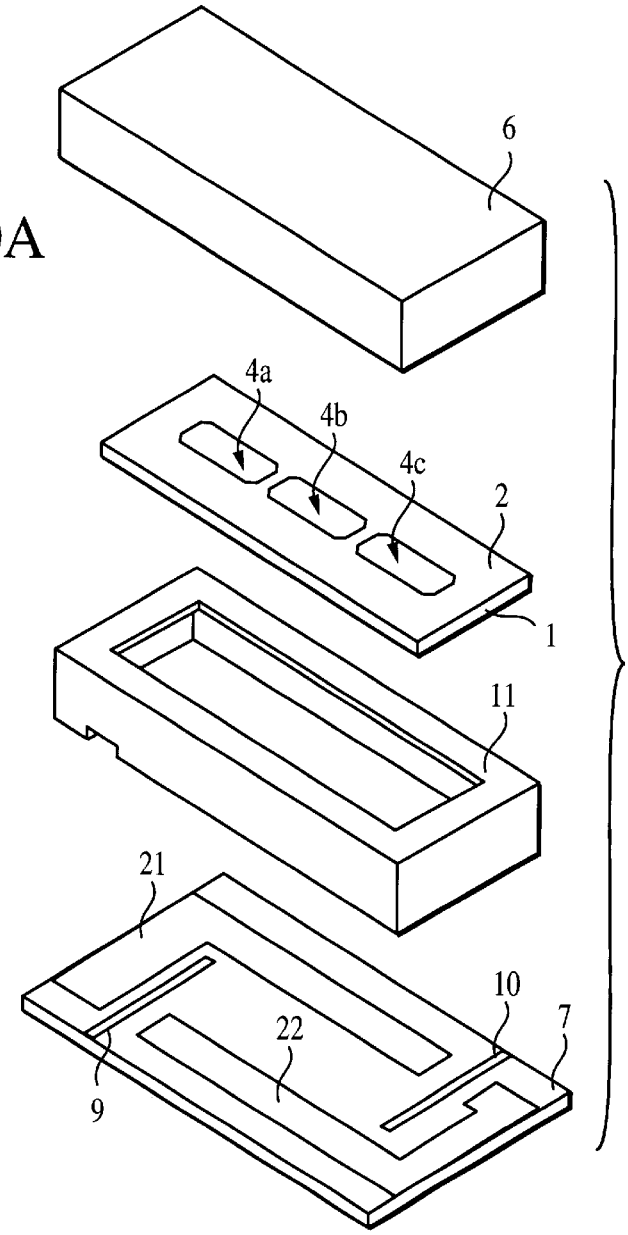
FIG. 10A is an exploded perspective view of a dielectric resonator device and FIG. 10B is a plan view of a dielectric plate according to another embodiment of the present invention.
Figure 10B:
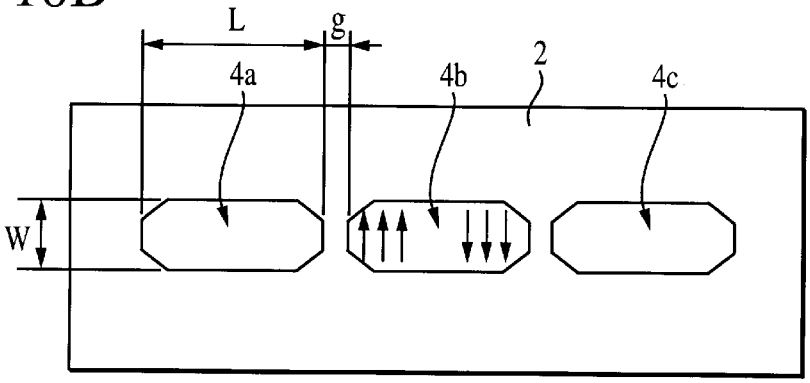
Figure 11A:
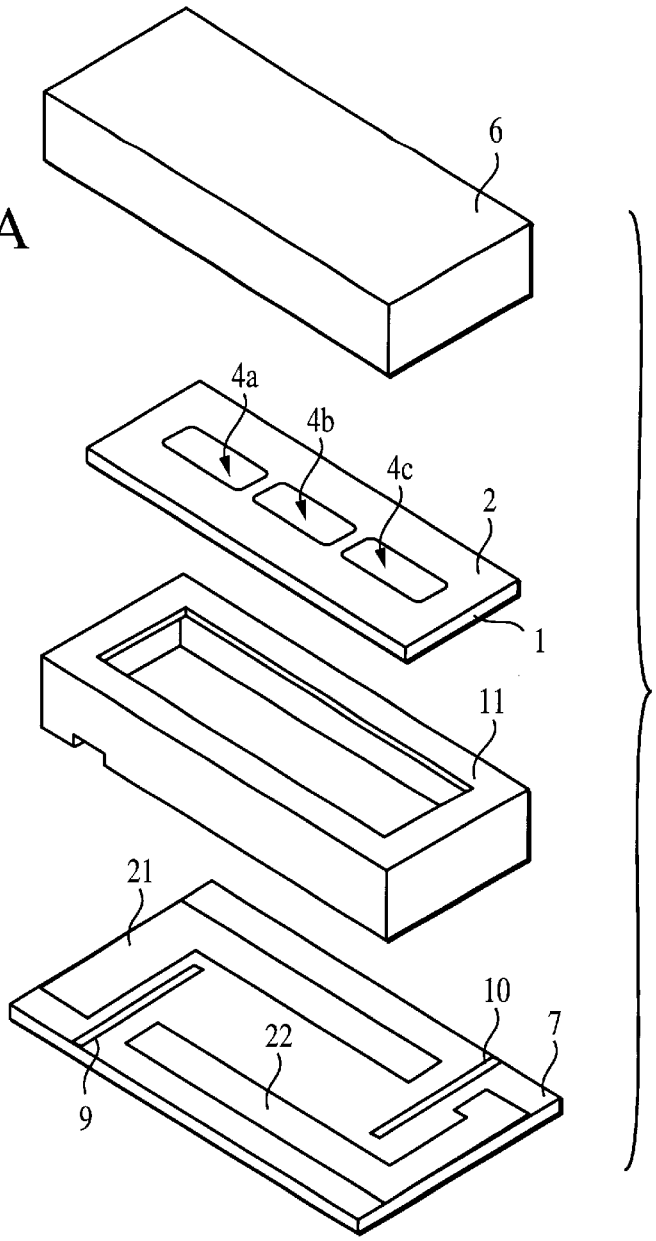
FIG. 11A is an exploded perspective view of a dielectric resonator device and FIG. 11B is a plan view of a dielectric plate according to another embodiment of the present invention.
Figure 11B:
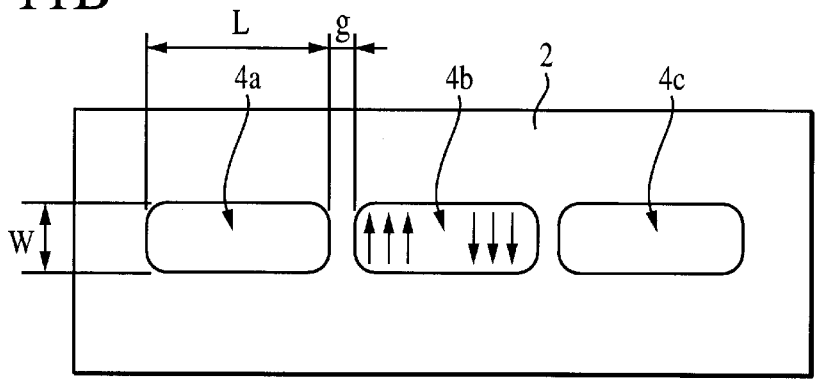

FIGS. 10A and 11 respectively show an exploded perspective view of a dielectric resonator device; and FIGS. 10B and 11B respectively show a plan view of a dielectric plate employed in the device. In FIGS. 10A and 10B, electrode openings 4*a*, 4*b*, and 4*c* are in a polygonal form in which the four corners of a rectangular form are cut off. In FIGS. 11A and 11B, electrode openings 4*a*, 4*b*, and 4*c* are in a form in which the four corners of a rectangular form are rounded. Other arrangements are the same as those shown in FIG. 1, and FIGS. 2A and 2B.

Such arrangements regarding forms of electrode openings shown in FIGS. 10A and 10B, and FIGS. 11A and 11B permit alleviation of current concentration at the four corners, leading to improvement in Q0. In addition, filter attenuation characteristics can also be improved, since degrees of detuning between a main mode and a spurious mode can be controlled by the manner in which the corners are cut off or the manner in which they are rounded off.

Although the example shown in FIGS. 10A and 10B adopts an octagonal form obtained by simply cutting off the four corners of the rectangular electrode opening, other polygonal forms may be applicable. The electrode opening having R-formed corners as shown in FIG. 11B is also included in the connotation of "substantially polygonal" described in the present invention.

Figure 12:
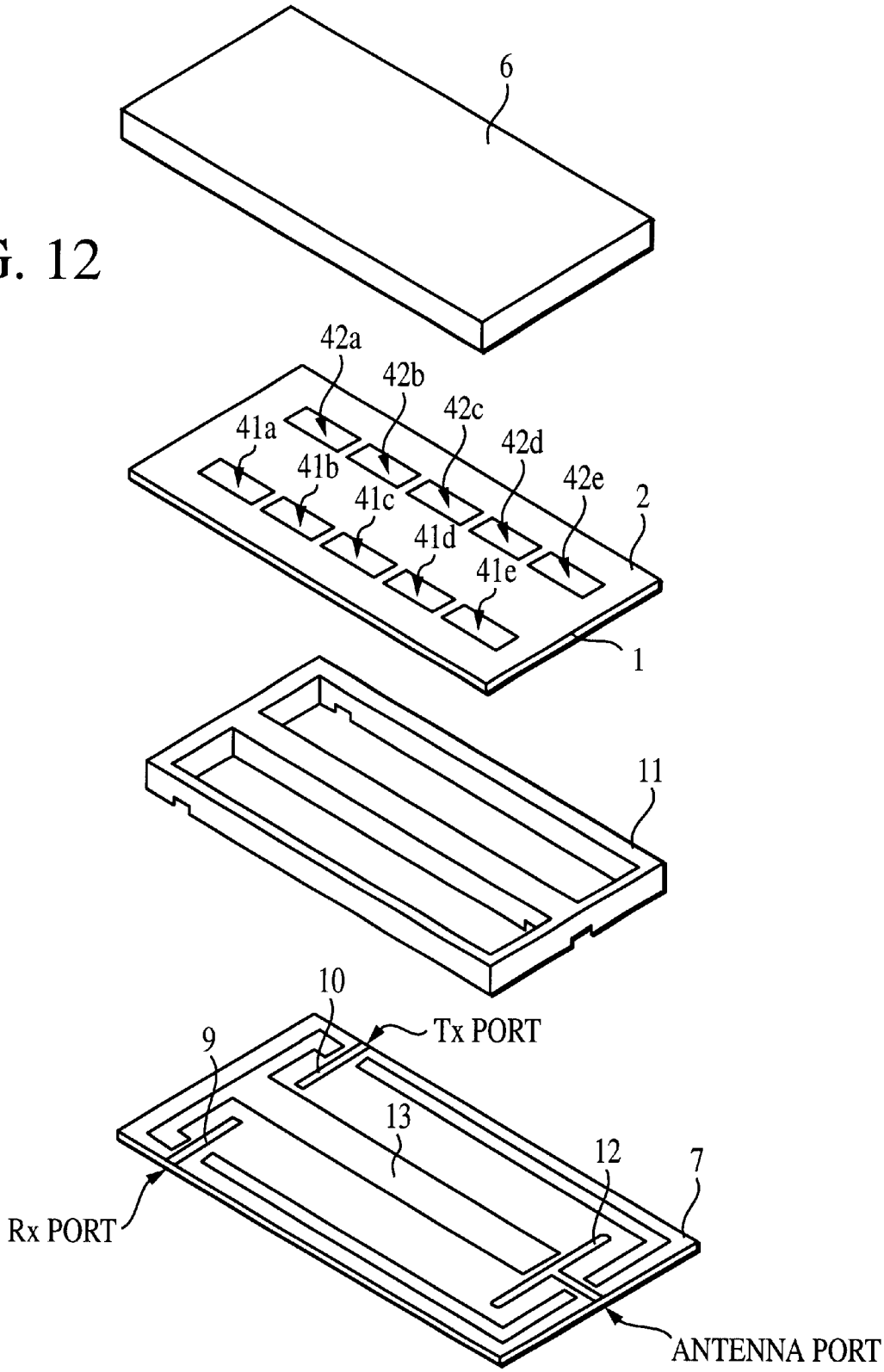
FIG. 12 is an exploded perspective view illustrating a structure of an antenna-shared unit.

FIG. 12 shows an example in which the transmission/reception-shared device of the present invention is used as an antenna-shared device. In this figure, reference numeral 1 denotes a dielectric plate; on each main surface of the plate are disposed electrodes having ten mutually opposing pairs of rectangular openings. There are shown 41*a* to 41*e* and 42*a* to 42*e* as electrode openings on the upper surface. Reference numeral 7 denotes an I/O substrate; on the top surface of which microstrip lines 9, 10, and 12 used as probes are formed; and a ground electrode is formed on the substantially entire lower surface of the substrate 7. Reference numeral 11 denotes a spacer in a metallic framed form. The spacer 11 is stacked on the I/O substrate 7 to stack the dielectric plate 1 thereon, so as to be arranged between the I/O substrate 7 and the dielectric plate 1 at a specified distance. A cut-away part is formed at each part opposing the microstrip lines 9 and 10 of the spacer 11, so that microstrip lines 9 and 10 are not shunted. Reference numeral 6 denotes a metallic cover, which performs electromagnetic shielding in the circumference of the dielectric plate 1 when it encloses the spacer 11.

In FIG. 12, there are provided five dielectric resonators formed of the electrode openings 41*a* to 41*e* formed on the top surface of the dielectric plate 1 and the opposing electrode openings on the lower surface of the same, in which sequential coupling between the mutually-adjacent dielectric resonators permits formation of a receiving filter having band pass characteristics made from the five-step resonators. Similar, there are provided another five dielectric resonators formed of the electrode openings 42*a* to 42*e* on the upper surface of the plate and the opposing electrode openings on the lower surface of the same, and these five dielectric resonators form a transmitting filter having band pass characteristics made from the five-step resonators.

The top end of the microstrip line 9 of the I/O substrate 7 is used as a receiving signal output port (Rx port) for the receiving filter, whereas the top end of the microstrip line 10 is used as a transmitting signal input port (Tx port) for the transmitting filter. The microstrip line 12 comprises a branch circuit and the top end of the line is used as an antenna port. The branch circuit performs branching between a transmitting signal and a receiving signal in such a manner that the electrical length between a branching point and an equivalently-shunted surface of the receiving filter is an odd multiple of one-fourth the wavelength of transmitting frequency; and the electrical length between a branching point and an equivalently-shunted surface of the transmitting filter is an odd multiple of one-fourth the wavelength of the receiving frequency.

The spacer 11 has a partition for separating the receiving filter from the transmitting filter. On the lower surface of the cover 6 is formed another partition for separating the receiving filter from the transmitting filter, although the partition is not shown in the figure. Furthermore, at parts to which the spacer 11 is attached on the I/O substrate 7 are arranged a plurality of through-holes for electrically connecting the electrodes on both surfaces of the I/O substrate. This structure allows isolation between the receiving filter and the transmitting filter.

As shown here, even if a plurality of resonators is disposed on a single substrate, the present invention allows production of a transmission/reception shared device having reduced insertion loss.

Figure 13:
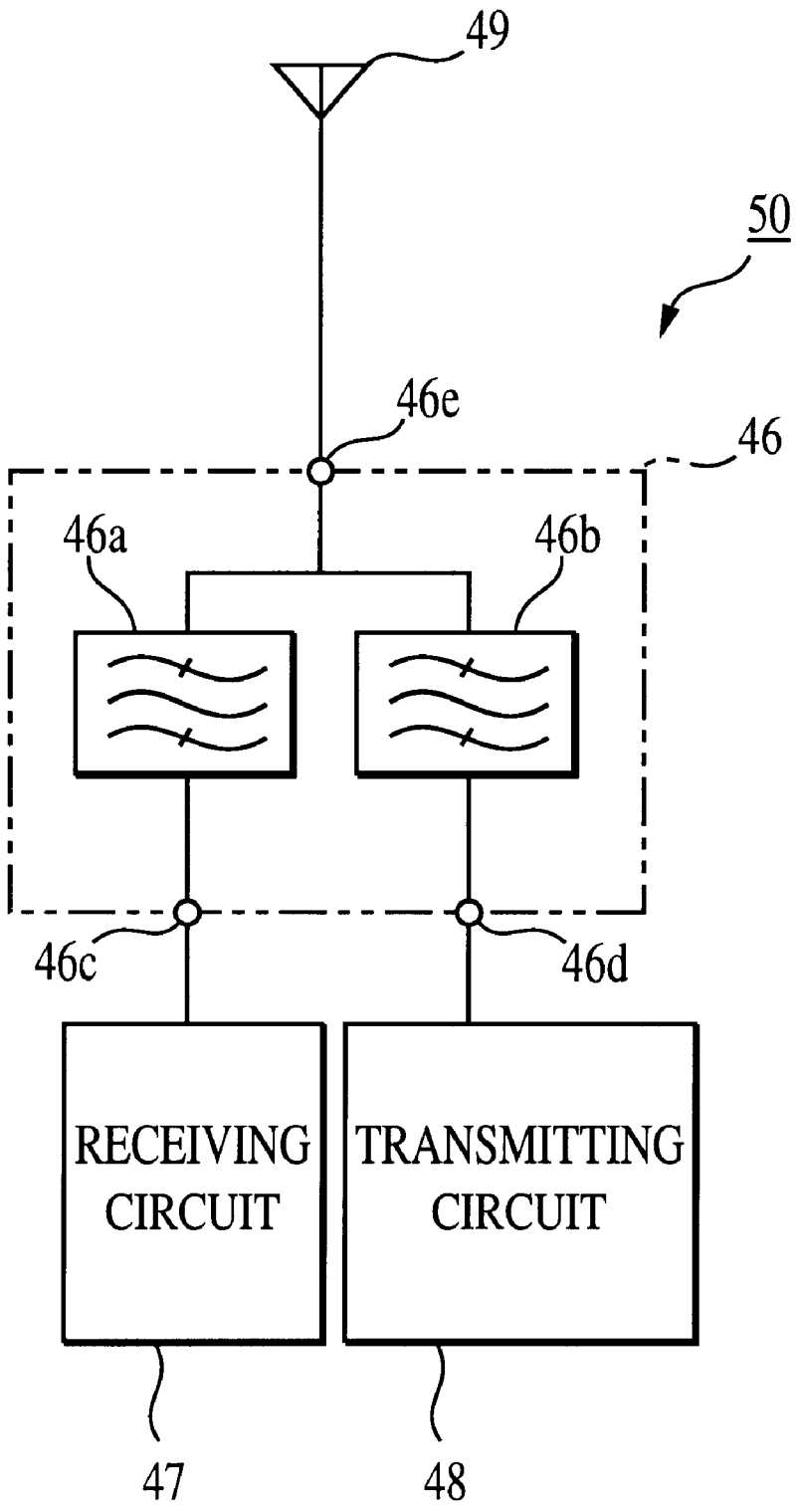
FIG. 13 is a block diagram illustrating a structure of a transceiver.
Figure 14:
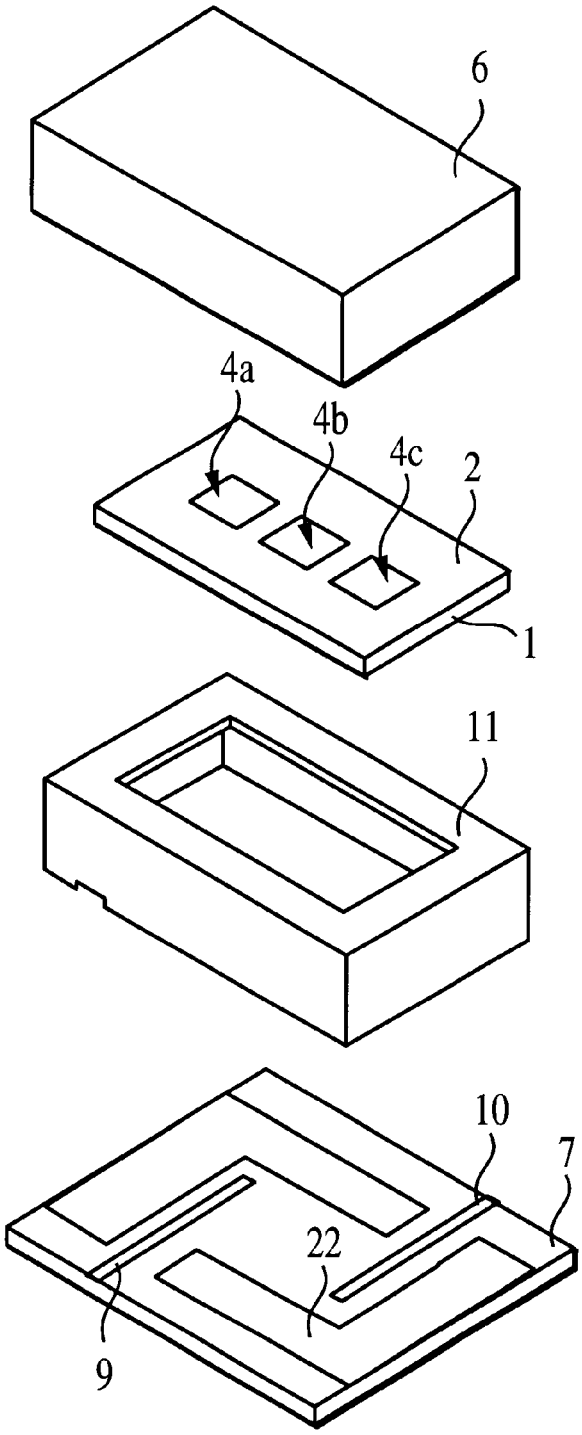
FIG. 14 PRIOR ART
FIG. 14 is an exploded perspective view illustrating a structure of a conventional dielectric resonator device.
Figure 15A:
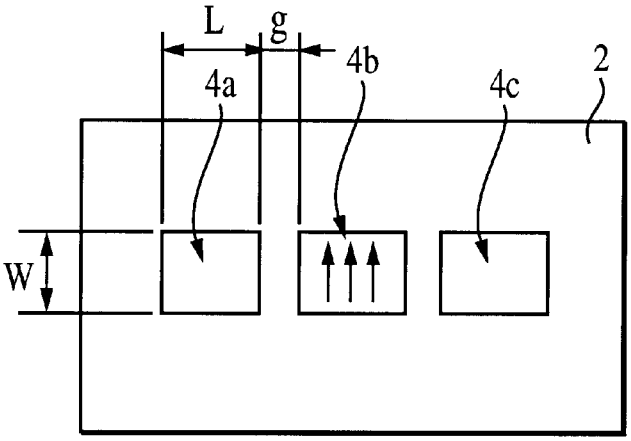
FIG. 15A PRIOR ART
FIGS. 15A, 15B, and 15C respectively show an example view of electromagnetic distribution of a resonator employed in the conventional dielectric resonator device.
Figure 15C:
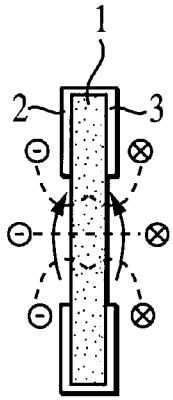
FIG. 15C PRIOR ART
Figure 15B:
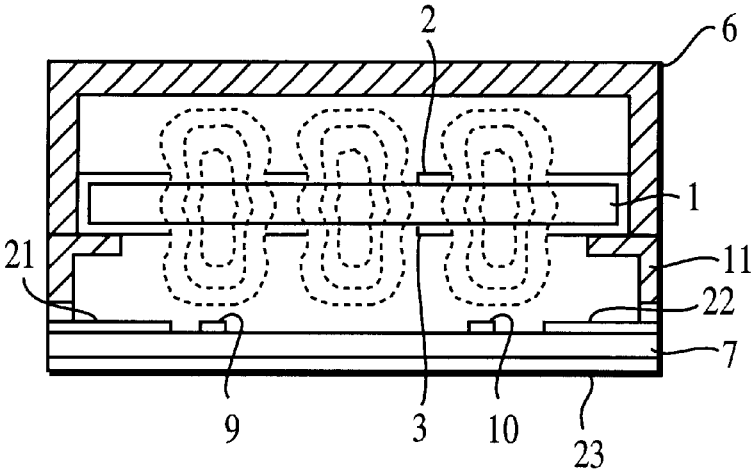
FIG. 15B PRIOR ART

FIG. 13 shows an embodiment of a transceiver incorporating the antenna-shared unit described above. In this figure, there are shown the receiving filter 46*a* and the transmitting filter 46*b*; in which the part indicated by reference numeral 46 comprises an antenna-shared unit. As shown in this figure, a receiving circuit 47 is connected to a receiving signal output port 46*c* of the antenna-shared unit 46; a transmitting circuit 48 is connected to a transmitting signal input port 46*d*; and an antenna port 46*e* is connected to an antenna 49. As a result, the overall structure as a whole forms a transceiver 50.

According to this invention, since the resonator unit resonates in a higher mode of the basic resonant mode, and an electrical barrier with no loss is formed between the gnarls of the electromagnetic field distribution, there is no conductor loss due to the electrical barrier, so that the overall conductor loss can be reduced. Accordingly, in the case of forming a filter, insertion loss is reduced, since Q0 of the resonator is higher.

In addition, since filter characteristic changes with respect to changes in the resonator length L and the gaps g between the resonators are smaller, a high level of dimensional accuracy in forming the electrodes is not necessarily demanded, thereby leading to enhancement of production efficiency.

Moreover, in this invention, since perturbation effects on electrical fields or magnetic fields can be differentiated corresponding to positions in which the electromagnetic energy density is distributed, giving perturbation independently to a part of a high distribution and a part of a low distribution in terms of the electromagnetic energy density permits both coarse adjustment and fine adjustment of resonant frequency. In an aspect of the present invention, the formation of the rectangular electrode opening facilitates formation of patterns of the electrode opening with respect to the dielectric plate so as to obtain a resonator of a specified resonant frequency.

In another aspect of the present invention, expanding the width of the electrode opening of the resonator unit coupled with the signal input unit or the signal output unit facilitates coupling between the resonator and the signal input unit or the signal output unit, despite that the resonator being a higher mode resonator having a high energy-lock-in effect.

Furthermore, in another aspect of the present invention, making the resonator unit coupled with the signal input unit or the signal output unit a resonator unit with a basic resonant mode can facilitate coupling between the resonator and the signal input unit or the signal output unit.

Moreover, in another aspect of the present invention, adopting such an arrangement that the dielectric resonator device is used as a transmitting filter and a receiving filter; the transmitting filter is disposed between the transmitting signal input port and the I/O port; and the receiving filter is disposed between the receiving signal output port and the I/O port permits production of a transmission/reception shared device with lower insertion loss.

In another aspect of present invention, adopting such an arrangement that a transmitting circuit is connected to the transmitting signal input port of the transmission/reception shared device; a receiving circuit is connected to the receiving signal output port of the transmission/reception shared device; and an antenna is connected to the I/O port of the transmission/reception shared device can provide a transceiver with high efficiency, namely, with smaller loss in a high frequency circuit.

What is claimed is:

1. A dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wave length of a basic resonant mode determined by a half-wave length in the resonant frequency used, so as to resonate in a higher mode of the basic resonant mode;

wherein a plurality of the openings are disposed to form respective resonators which are mutually coupled with each other, and pairs of the openings with different lengths L are included.

2. The device of claim 1, wherein a plurality of the openings are disposed to form respective resonators, which are mutually coupled with each other; and pairs of the openings with mutually different widths W are included.

3. The device of claim 2, wherein the width W of the opening used as the resonator coupled with the signal input unit or the signal output unit is longer than that of the opening used as another resonator.

4. A dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wave length of a basic resonant mode determined by a half-wave length in the resonant frequency used, so as to resonate in a higher mode of the basic resonant mode; and wherein the length L of the opening used as the resonator coupled with the signal input unit or the signal output unit is different from that of the opening used as another resonator.

5. The device of claim 4, wherein a plurality of the openings are disposed to form respective resonators, which are mutually coupled with each other; and pairs of the openings with mutually different widths W are included.

6. The device of claim 5, wherein the width W of the opening used as the resonator coupled with the signal input unit or the signal output unit is longer than that of the opening used as another resonator.

7. A dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wavelength of a basic resonant mode determined by a half-wavelength at the resonant frequency used, so as to resonate in a higher mode of the basic resonant mode; and wherein the width W of the opening used as the resonator coupled with the signal input unit or the signal output unit is longer than that of the opening used as another resonator.

8. A dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wavelength of a basic resonant mode determined by a half-wavelength at the resonant frequency used, so as to resonate in a higher mode of the basic resonant mode; and wherein the resonator coupled with the signal input unit or the signal output unit is a basic mode resonator.

9. A dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wavelength of a basic resonant mode determined by a half-wavelength at the resonant frequency used, so as to resonate in a higher mode of the basic resonant mode;

wherein the openings are rectangular; and wherein said rectangular openings have cut-off corners.

10. A dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wavelength of a basic resonant mode determined by a half-wavelength at the resonant frequency used, so as to resonate in a higher mode of the basic resonant mode;

wherein the openings are rectangular; and wherein said rectangular openings have rounded corners.

11. A transmission/reception shared device containing a dielectric resonator device, the dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wave length of a basic resonant mode determined by a half-wave length in the resonant frequency used, so as to resonate in a higher mode of the basic resonant mode;

wherein the dielectric resonator device is used as one of a transmitting filter disposed between a transmitting signal input port and an I/O port and a receiving filter disposed between a receiving signal output port and the I/O port; and wherein the openings are rectangular.

12. The device of claim 11, wherein said rectangular openings have cut-off corners.

13. The device of claim 11, wherein said rectangular openings have rounded corners.

14. A transmission/reception shared device containing a dielectric resonator device, the dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of a least one of the openings is longer than a half-wave length of a basic resonant mode determined by a half-wave length in the resonant frequency used, so as to resonate in a higher mode of the basic resonant mode;

wherein the dielectric resonator device is used as one of a transmitting filter disposed between a transmitting signal input port and an I/O port and a receiving filter disposed between a receiving signal output port and the I/O port; and wherein a plurality of the openings are disposed to form respective resonators, which are mutually coupled with each other; and pairs of the openings with mutually different widths W are included.

15. The device of claim 14, wherein the width W of the opening used as the resonator coupled with the signal input unit or the signal output unit is longer than that of the opening used as another resonator.

16. The device of claim 15, wherein a plurality of the openings are disposed to form respective resonators which are mutually coupled with each other, and pairs of the openings with different lengths L are included.

17. The device of claim 15, wherein the length L of the opening used as the resonator coupled with the signal input unit or the signal output unit is different from that of the opening used as another resonator.

18. The device of claim 14, wherein a plurality of the openings are disposed to form respective resonators which are mutually coupled with each other, and pairs of the openings with different lengths L are included.

19. The device of claim 14, wherein the length L of the opening used as the resonator coupled with the signal input unit or the signal output unit is different from that of the opening used as another resonator.

20. A transmission/reception shared device containing a dielectric resonator device, the dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wave length of a basic resonant mode determined by a half-wave length in the resonant frequency used, so as to resonate in a higher mode of the basic resonant mode;

wherein the dielectric resonator device is used as one of a transmitting filter disposed between a transmitting signal input port and an I/O port and a receiving filter disposed between a receiving signal output port and the I/O port; and wherein a plurality of the openings are disposed to form respective resonators, which are mutually coupled; and a basic mode resonator and a higher mode resonator are disposed together.

21. The device of claim 20, wherein the resonator coupled with the signal input unit or the signal output unit is the basic mode resonator.

22. A transmission/reception shared device containing a dielectric resonator device, the dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wave length of a basic resonant mode determined by a half-wave length in the resonant frequency used, so as to resonate in a higher mode of the basic resonant mode;

wherein the dielectric resonator device is used as one of a transmitting filter disposed between a transmitting signal input port and an I/O port and a receiving filter disposed between a receiving signal output port and the I/O port; and wherein a plurality of the openings are disposed to form respective resonators which are mutually coupled with each other, and pairs of the openings with different lengths L are included.

23. A transmission/reception shared device containing a dielectric resonator device, the dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wave length of a basic resonant mode determined by a half-wave length in the resonant frequency used, so as to resonate in a higher mode of the basic resonant mode;

wherein the dielectric resonator device is used as one of a transmitting filter disposed between a transmitting signal input port and an I/O port and a receiving filter disposed between a receiving signal output port and the I/O port; and wherein the length L of the opening used as the resonator coupled with the signal input unit or the signal output unit is different from that of the opening used as another resonator.

24. A transmission/reception shared device containing a dielectric resonator device, the dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wave length of a basic resonant mode determined by a half-wave length in the resonant frequency used, so as to resonate in a higher mode of the basic resonant mode;

wherein the dielectric resonator device is used as one of a transmitting filter disposed between a transmitting signal input port and an I/O port and a receiving filter disposed between a receiving signal output port and the I/O port; and wherein the width W of the opening used as the resonator coupled with the signal input unit or the signal output unit is longer than that of the opening used as another resonator.

25. A transmission/reception shared device containing a dielectric resonator device, the dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wave length of a basic resonant mode determined by a half-wave length in the resonant frequency used, so as to resonate in a higher mode of the basic resonant mode;

wherein the dielectric resonator device is used as one of a transmitting filter disposed between a transmitting signal input port and an I/O port and a receiving filter disposed between a receiving signal output port and the I/O port; and wherein the resonator coupled with the signal input unit or the signal output unit is basic mode resonator.

26. A transceiver comprising:

a transmitting circuit connected to a transmitting signal input port of a transmission/reception shared device;

a receiving circuit connected to a receiving signal output port of said transmission/reception shared device; and an antenna terminal connected to an I/O port of said transmission/reception shared device;

said transmission/reception shared device containing a dielectric resonator device, the dielectric resonator deivce comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wave length of a basic resonant mode determined by a half-wave length in the resonant frequency used, so as to resonate in a higher mode of the basic resonant mode;

wherein the dielectric resonator device is used as one of a transmitting filter disposed between a transmitting signal input port and an I/O port and a receiving filter disposed between a receiving signal output port and the I/O port; and wherein the openings are rectangular.

27. The transceiver of claim 26, wherein said rectangular openings have cut-off corners.

28. The transceiver of claim 26, wherein said rectangular openings have rounded corners.

29. A transceiver comprising:

a transmitting circuit connected to a transmitting signal input port of a transmission/reception shared device;

a receiving circuit connected to a receiving signal output port of said transmission/reception shared device; and an antenna terminal connected to an I/O port of said transmission/reception shared device;

said transmission/reception shared device containing a dielectric resonator device, the dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wave length of a basic resonant mode determined by a half-wave length in the resonant frequency used, so as to resonate in a higher mode of the basic resonant mode;

wherein the dielectric resonator device is used as one of a transmitting filter disposed between a transmitting signal input port and an I/O port and a receiving filter disposed between a receiving signal output port and the I/O port; and wherein a plurality of the openings are disposed to form respective resonators, which are mutually coupled with each other; and pairs of the openings with mutually different widths W are included.

30. The transceiver of claim 29, wherein the width W of the opening used as the resonator coupled with the signal input unit or the signal output unit is longer than that of the opening used as another resonator.

31. The transceiver of claim 30, wherein a plurality of the openings are disposed to form respective resonators which are mutually coupled with each other, and pairs of the openings with different lengths L are included.

32. The transceiver of claim 30, wherein the length L of the opening used as the resonator coupled with the signal input unit or the signal output unit is different from that of the opening used as another resonator.

33. The transceiver of claim 29, wherein a plurality of the openings are disposed to form respective resonators which are mutually coupled with each other, and pairs of the openings with different lengths L are included.

34. The transceiver of claim 29, wherein the length L of the opening used as the resonator coupled with the signal input unit or the signal output unit is different from that of the opening used as another resonator.

35. A transceiver comprising:

a transmitting circuit connected to a transmitting signal input port of a transmission/reception shared device;

a receiving circuit connected to a receiving signal output port of said transmission/reception shared device; and an antenna terminal connected to an I/O port of said transmission/reception shared device;

said transmission/reception shared device containing a dielectric resonator device, the dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wave length of a basic resonant mode determined by a half-wave length in the resonant frequency used, so as to resonate in a higher mode of the basic resonant mode;

wherein the dielectric resonator device is used as one of a transmitting filter disposed between a transmitting signal input port and an I/O port and a receiving filter disposed between a receiving signal output port and the I/O port; and wherein a plurality of the openings are disposed to form respective resonators, which are mutually coupled; and a basic mode resonator and a higher mode resonator are disposed together.

36. The transceiver of claim 35, wherein the resonator coupled with the signal input unit or the signal output unit is the basic mode resonator.

37. A transceiver comprising:

a transmitting circuit connected to a transmitting signal input port of a transmission/reception shared device;

a receiving circuit connected to a receiving signal output port of said transmission/reception shared device; and an antenna terminal connected to an I/O port of said transmission/reception shared device;

said transmission/reception shared device containing a dielectric resonator device, the dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wave length of a basic resonant mode determined by a half-wave length in the resonant frequency used, so as to resonate in a higher mode of the basic resonant mode;

wherein the dielectric resonator device is used as one of a transmitting filter disposed between a transmitting signal input port and an I/O port and a receiving filter disposed between a receiving signal output port and the I/O port; and wherein a plurality of the openings are disposed to form respective resonators which are mutually coupled with each other, and pairs of the openings with different lengths L are included.

38. A transceiver comprising:

a transmitting circuit connected to a transmitting signal input port of a transmission/reception shared device;

a receiving circuit connected to a receiving signal output port of said transmission/reception shared device; and an antenna terminal connected to an I/O port of said transmission/reception shared device;

said transmission/reception shared device containing a dielectric resonator device, the dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wave length of a basic resonant mode determined by a half-wave length in the resonant frequency used, so as to resonate in a higher mode of the basic resonant mode;

wherein the dielectric resonator device is used as one of a transmitting filter disposed between a transmitting signal input port and an I/O port and a receiving filter disposed between a receiving signal output port and the I/O port; and wherein the length L of the opening used as the resonator coupled with the signal input unit or the signal output unit is different from that of the opening used as another resonator.

39. A transceiver comprising:

a transmitting circuit connected to a transmitting signal input port of a transmission/reception shared device;

a receiving circuit connected to a receiving signal output port of said transmission/reception shared device; and an antenna terminal connected to an I/O port of said transmission/reception shared device;

said transmission/reception shared device containing a dielectric resonator device, the dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wave length of a basic resonant mode determined by a half-wave length in the resonant frequency used, so as to resonate in a higher mode of the basic resonant mode;

wherein the dielectric resonator device is used as one of a transmitting filter disposed between a transmitting signal input port and an I/O port and a receiving filter disposed between a receiving signal output port and the I/O port; and wherein the width W of the opening used as the resonator coupled with the signal input unit or the signal output unit is longer than that of the opening used as another resonator.

40. A transceiver comprising:

a transmitting circuit connected to a transmitting signal input port of a transmission/reception shared device;

a receiving circuit connected to a receiving signal output port of said transmission/reception shared device, and an antenna terminal connected to an I/O port of said transmission/reception shared device;

said transmission/reception shared device containing a dielectric resonator device, the dielectric resonator device comprising:

a dielectric plate;

an electrode disposed on each main surface of the plate;

at least one pair of substantially-polygonal mutually-opposing openings formed in the electrodes, each of said openings defining a longer side direction and a shorter side direction;

a signal input unit for inputting signals from the outside by coupling with a resonator formed of the electrode openings; and a signal output unit for outputting signals to the outside by coupling with the resonator;

wherein the length L in the longer side direction of at least one of the openings is longer than a half-wave length of a basic resonant mode determined by a half-wave length in the resonant frequency used, so as to resonate in a higher mode of the basic resonant mode;

wherein the dielectric resonator device is used as one of a transmitting filter disposed between a transmitting signal input port and an I/O port and a receiving filter disposed between a receiving signal output port and the I/O port; and wherein the resonator coupled with the signal input unit or the signal output unit is a basic mode resonator.

* * * * *